United States Patent [19]

Stöckl et al.

[11] Patent Number: 4,505,514

[45] Date of Patent: Mar. 19, 1985

[54] CHAIR FOR DENTAL PATIENTS

[75] Inventors: Klaus Stöckl; Reinhard Engert, both of Heppenheim, Fed. Rep. of Germany

[73] Assignee: Siemens Aktiengesellschaft, Berlin & Munich, Fed. Rep. of Germany

[21] Appl. No.: 470,003

[22] Filed: Feb. 25, 1983

[30] Foreign Application Priority Data

Mar. 17, 1982 [DE] Fed. Rep. of Germany ..... 3209773

[51] Int. Cl.[3] ..... A61G 15/00

[52] U.S. Cl. ..... 297/322; 297/316; 297/330; 297/342

[58] Field of Search ..... 297/330, 342, 316, 317, 297/318, 320, 321, 322, 337, 83, 86

[56] References Cited

U.S. PATENT DOCUMENTS

| | | | |
|---|---|---|---|
| Re. 30,648 | 6/1981 | Ohlrogge . | |
| 2,578,708 | 12/1951 | Lorenz | 297/86 |
| 2,714,922 | 8/1955 | McKibban et al. | 297/83 |
| 2,860,691 | 11/1958 | Caesar | 297/322 |
| 3,405,900 | 10/1968 | Robinson | 297/330 |
| 3,948,559 | 4/1976 | Hain et al. | 297/330 |

FOREIGN PATENT DOCUMENTS

| | | | |
|---|---|---|---|
| 620822 | 5/1961 | Canada | 297/83 |
| 1940646 | 2/1971 | Fed. Rep. of Germany | 297/330 |
| 2226572 | 8/1980 | Fed. Rep. of Germany . | |
| 3130444 | 2/1983 | Fed. Rep. of Germany | 297/330 |
| 1434307 | 5/1976 | United Kingdom . | |

*Primary Examiner*—William E. Lyddane
*Assistant Examiner*—Mark W. Binder
*Attorney, Agent, or Firm*—Hill, Van Santen, Steadman & Simpson

[57] ABSTRACT

A dental chair having a support frame, a seat with a seat frame, a back rest pivotally connected to the seat and a displacement device for moving the seat frame on the support frame with tilting of the seat and an arrangement for controlling the inclination of the back rest, characterized by the pivotal connection between the seat comprising a separate pivoting bearing on each side having a pivot axis approximately in the area of the hip joint of a person sitting in the chair and the arrangement for controlling the inclination of the back rest comprising a one-piece member having two lever arms being pivotally connected on the side of the seat frame with one of the lever arms having a roller riding on the track on the support frame and the other lever arm being connected to a projection of a part of the pivoting bearing which is attached to the seat rest so that as the seat frame is moved between positions, the roller moving on the track enables the back to change its degree of inclination to the seat. The chair also includes an arrangement for tilting the seat which includes at least one pair of guide members which are inclined to each other by approximately 160° and are mounted in the seat frame, which guide members receive sleeves that are pivotally connected to the support frame.

17 Claims, 4 Drawing Figures

CHAIR FOR DENTAL PATIENTS

BACKGROUND OF THE INVENTION

The present invention is directed to a chair for dental patients comprising a chair base or substructure containing a support frame, a chair superstructure containing a seat having a seat frame, a back rest and an arrangement for pivotally hinging the back rest to the seat. In addition, the chair includes a displacement means which moves the chair frame on the support frame in a straight line manner between a first position and a second extended position with a control arrangement which controls inclination of the back rest as the seat moves between the first and second position by holding the back rest in an upright position when the seat is in a first position and tilting the back rest as the seat moves toward the second position and finally a tilting arrangement for tilting the seat as it moves from the first toward the second position.

A chair for a dental patient which has an arrangement for tilting the seat as it moves between a first position and an extended position as well as for tilting the back rest from a vertical position to an inclined position is disclosed in British patent specification No. 1,434,307 which is based on the application resulting in German Pat. No. 2,226,572. In the arrangement of these references, two parallel extending guide rods are secured on a seat frame and slidably receive sleeves which are connected to each other by a cross member and are secured to a support frame of the substructure of the device by a pivotable arrangement. In addition, the seat frame and the support frame have a roller and track arrangement so that as the seat moves between a first and second position, the seat is tilted. The back rest is pivoted to the seat and the chair arrangement includes a means for pivoting the back rest from an upright position to an inclined position as the seat moves between the first and second displaced positions. Thus, when the seat is moved from a first position with the back rest in an upright position, toward the second position, not only is the back rest tilted or inclined, but the seat itself with the corresponding foot end will be tilted upward. When the motion is reversed, the front end with the foot rest will be tilted downward and the back rest will be raised to the upright position.

To induce the guidance of the back rest during motion of the seat, a rigid connecting rod designed as an arm rest is pivotally connected to the back rest and on the other hand to the support frame.

In order to accommodate the demand for better accessibility to the patient chair, particularly when entering and departing the chair, it has already been proposed to eliminate the arm rest at the entry and departure side of the chair or to construct it so that it can be pivotally mounted and swung out of the way during entry. Such a construction which has only a single side arm rest or which has the pivotal arm rest on the other side raises problems with proper power transmission between the back rest and the support frame. If one wishes to achieve a sufficient stability, then among other things, a very involved, torsion-proof support frame for the seat and the back rest must be provided.

SUMMARY OF THE INVENTION

The present invention is directed to providing an improved chair for dental patients which will have an automatically tilting back as the seat is moved or displaced and which enables a combination of the motions to be achieved without requiring a lateral arm rest or similar linkage between the chair and back rest which linkage would disrupt the free access to the chair. In addition, the present invention is directed to providing a chair which has a controlled back rest without the provision of the arm rest or linkage which chair has sufficient stability without requiring a particularly torsion-proof support frame.

To accomplish these goals and objects, the present invention is directed to an implement in a chair for a dental patient comprising a chair substructure containing a support frame, a superstructure containing a seat having a seat frame, a back rest, means for pivotally hinging the back rest to the seat, displacement means being disposed between the support frame and the chair frame including a straight line mechanism for shifting the seat frame between a first position with the seat being substantially level and a second position with the seat moved the maximum amount from the first position, control means for controlling the inclination of the back rest as the seat moves between the first and second position, said control means holding the back rest in an upright position when the seat is in the first position and tilting the back rest as the seat moves toward the second position, and means for tilting the seat as it moves from the first toward the second position. The improvements comprise the means for pivotally hinging the back rest to the seat including a separate pivot bearing, having a pivot axis approximately in the area of the hip joint of a person sitting in the chair, said pivotal bearing including a part rigidly connected to the back rest, said control means comprising a first lever arm mounted on the seat frame for pivotal movement on a second pivot axis, a second lever arm mounted for pivotal movement on a second pivot axis and rigidly connected to move with the first arm, a projection on of the bearing parts of the back rest extending into the seat adjacent the seat frame, and a tie rod connecting said end of said projection to the first arm, said second arm having a roller riding on a track disposed on the support frame so that the second and first arms pivot around the second pivot axis as the seat frame moves from the first position toward the second position to allow the back rest to pivot on the bearing means.

Preferably, there are two pivot bearings arranged on each side of the seat. In addition, the projection on the bearing part, the tie rod, the first and second levers are disposed on each side of the back rest and the portion of the seat frame. Preferably, the first and second levers have the same length so that they form an isosceles triangle and preferably they are a one-piece member with the two lever portions.

Another improvement of the present invention is that the means for tilting a seat as it moves from the first toward the second position comprises a pair of slide guides, preferably one pair on each side of the chair frame, said slide guides on each pair being inclined at an obtuse angle relative to each other with each guide receiving a single slide bushing or member which is pivotably mounted to the support frame. Thus, during displacement between the first and second positions, the slide guides move in their respective pivotal bushing to tilt the seat and the foot rest associated therewith. Preferably, the two guides on each side are inclined at an angle of approximately 10° to the horizontal direction or 160° to each other.

Since the pivot bearing for the back rest lies approximately in the area of the hip joint of the person sitting in the chair, the inventive structure of the chair has the advantage that practically no "stretch effect" is present. In addition, the back rest is practically self-bearing and accordingly requires no anti-torsion support frame, and both the chair sides are free of arm rest or linkage of the prior art devices.

A further advantage of the inventive structure is seen wherein the back rest exhibits no mechanical coupling in the direction of its erect position can accordingly be lifted in any phase of inclination and thus satisfies a safety requirement.

The proposed structure for guiding the chair top or back rest also has the advantage that no counterweights need be provided in the area of the leg rest as is the case of previously known chairs for safety reasons. Without these counterweights, problems with potential tilting motion of the extreme chair positions are eliminated.

DESCRIPTION OF THE PREFERRED EMBODIMENTS

Figure 2:
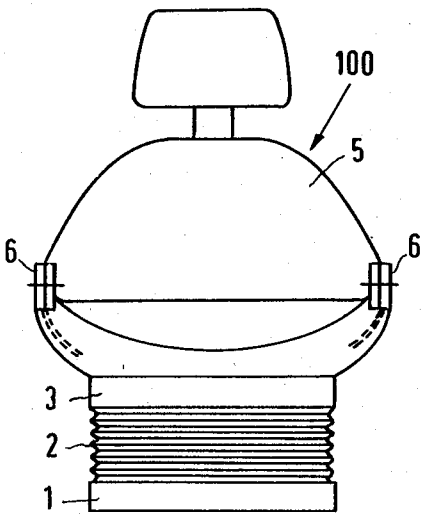
FIG. 2 is an end view of the chair of FIG. 1.
Figure 1:
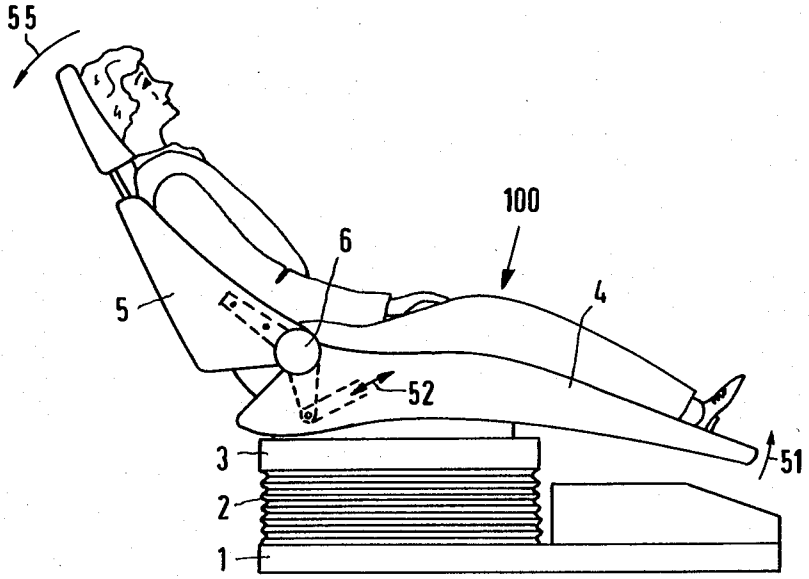
FIG. 1 is a side view of a chair for a dental patient in accordance with the present invention.

The principles of the present invention are particularly useful in a chair generally indicated at 100 in FIGS. 1 and 2 for holding a dental patient. The chair 100 comprises a base 1, height adjustment means 2 which is not illustrated in great detail and is positioned between the base 1 and a support frame 3 of the substructure of the chair. The chair has a superstructure which is formed by a seat 4 and a back rest 5. As illustrated, the seat 4 and back rest 5 are connected to one another by means of a hinge or bearing arrangement 6. The hinge 6 is provided on both sides of the chair, as best illustrated in FIG. 2, and is situated approximately in the area of the hip joint of the person sitting in the chair. With such a location, pivoting of the back rest 5 relative to the seat 4 on an axis formed by the two hinges 6 will not cause any stretching on the patient as the patient sits in the chair during such movement.

Figure 3:
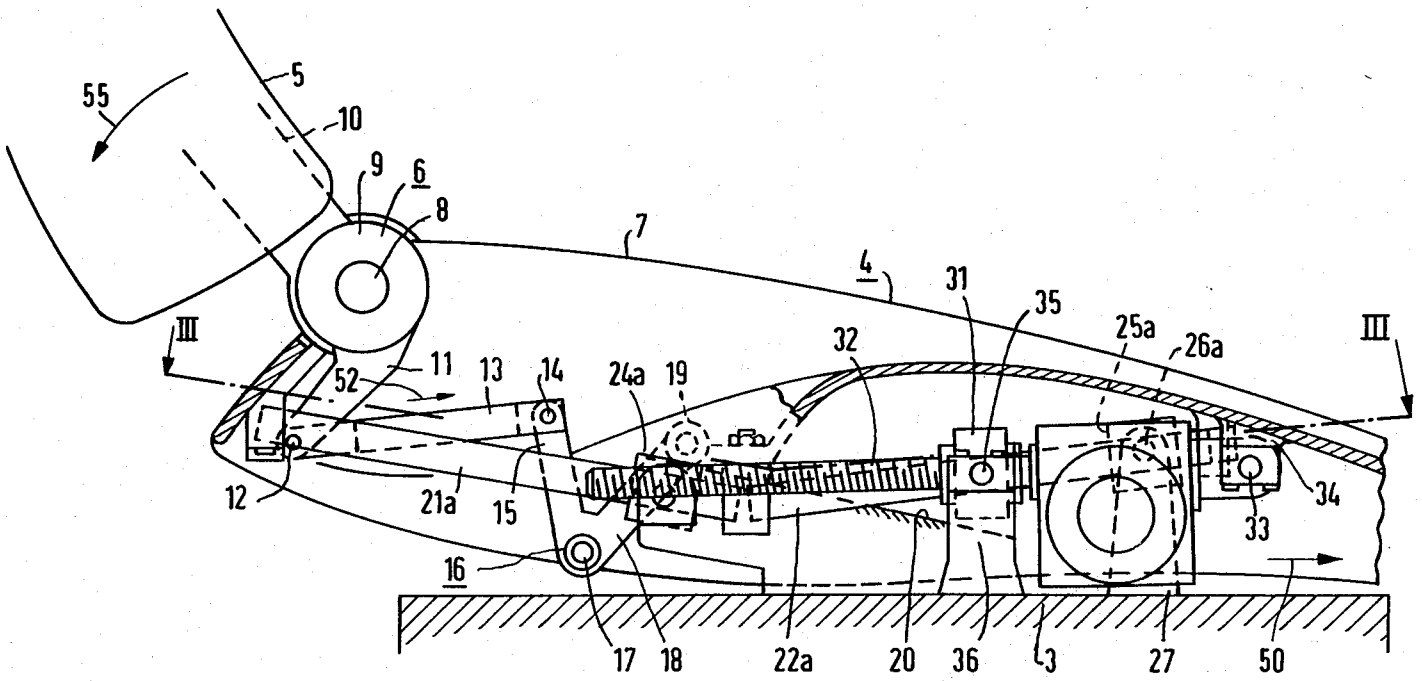
FIG. 3 is a longitudinal cross-section through a seat of the chair in accordance with the present invention.
Figure 4:
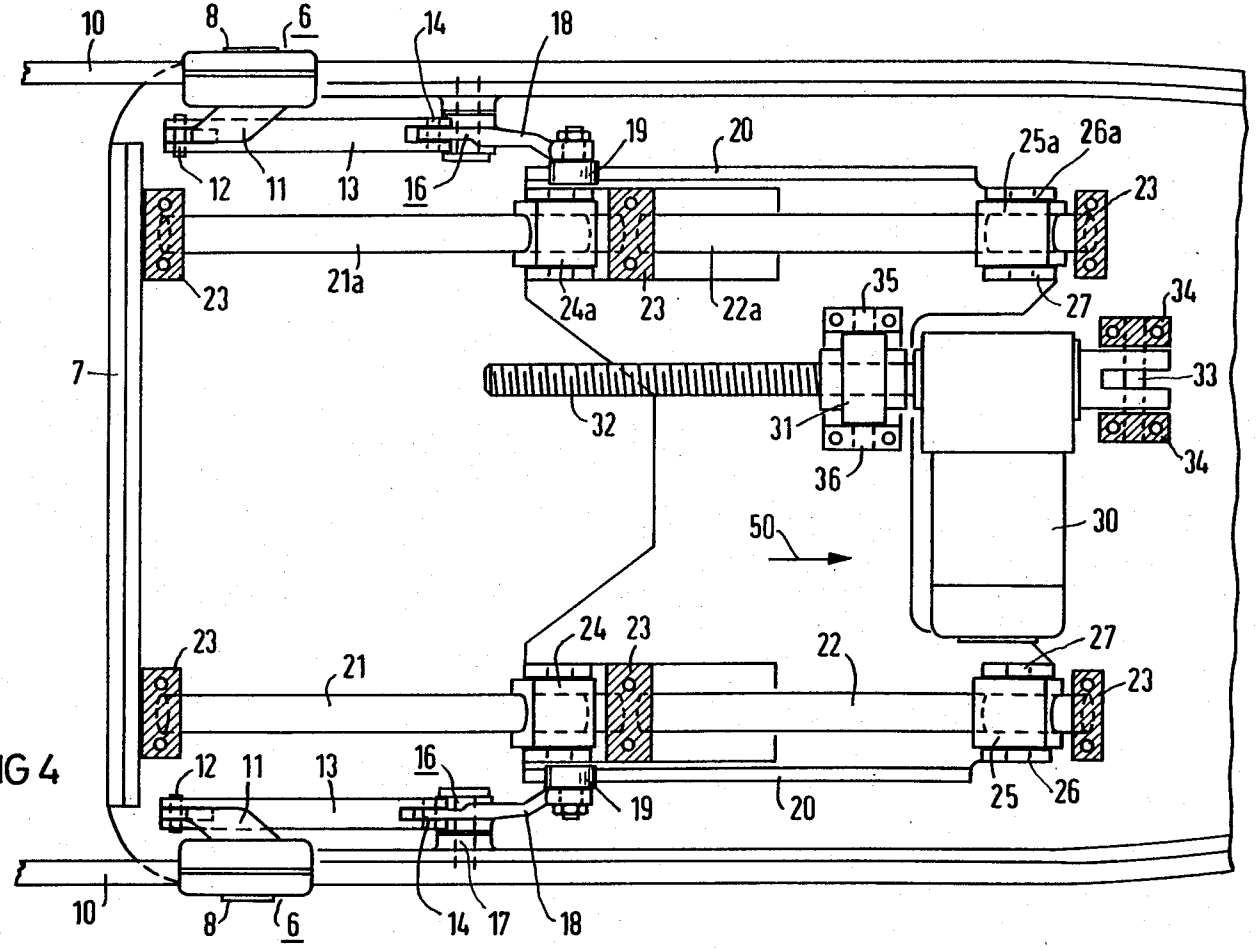
FIG. 4 is a cross-sectional view with portions in elevation taken generally on line III—III of FIG. 3.

As best illustrated in FIGS. 3 and 4, each of the hinges 6 consist of a shaft or tappet 8 which extends from the seat frame 7. A bearing part 9 is pivotally mounted on the tappet 8 and has a portion 10 which is fastened to the back rest 5 and also a projection or lever portion 11 which extends down into the seat frame 7. As illustrated, the portions 10 and 11 are rigid with respect to each other so that both portions move as the part 9 rotates on the shaft 8. Mounted on each side of the seat frame 7 is a one-piece lever arrangement which is mounted for rotation on a shaft 17 which forms a second pivot axis. As illustrated, the one-piece member 16 has a first lever 15, which is pivotally connected at 14 to a tie rod 13 whose other end is pivotally connected to an end of the projection 11 by a pivotal connection 12. The other lever 18 of the element 16 terminates in a roller 19 which engages a track 20 that is secured on the support frame 3 of the substructure of the chair 100. As illustrated, the lengths of the arms 15 and 18 are such that the distance between the joints 14 and 17 as well as between the roller 19 and the joint 14 form an isosceles triangle. The dimensions of the lever arms as well as the disposition of the bearing point 6 and the curvature of the track 20 will control the amount of tilting or inclination of the back rest 5. It also should be noted that the seat 4 as it moves in the direction 50 will be tilted with the foot rest being moved upwardly as indicated by the arrow 51 in FIG. 1. This tilting is also considered due to the fact that the pivot axis formed by the connection 17 moves with the chair.

The tilting of the seat 4 as it is shifted from the first position in the direction of arrow 50 toward an extended position is best illustrated in FIGS. 3 and 4. As illustrated in FIG. 4, a means for controlling the tilting comprises a pair of sliding guide rods 21 and 22 which are mounted on one side of the seat frame 7 and a second pair **21*a* and 22*a* which are mounted on the other side and parallel to the first pair. As illustrated, the two pairs 21, 21*a* and 22, 22*a* are mounted by a plurality of fastening blocks 23 to the frame 7. These blocks as best illustrated in FIG. 3 mount the two guide rods such as 21*a* and 22*a* to have an oblique angle of about 160° with each other so that each of the rods forms an angle of approximately 10° to the horizontal. The angle of the inclination of each of the rods such as 21 and 22** will then determine the degree by which the seat and leg rest is lifted or tilted.

Referring to FIG. 4, each of the guide rods 21, **21*a* and 22, 22*a* slidably receive a guide bushing or block with the rod 21 receiving the block 24, the rod 21*a* receiving the block 24*a*, the rod 22 receiving the block 25 and the rod 22*a* receiving the block 25*a*. Each of these blocks or guide bushings 24 and 25 are pivotably hinged to a support frame 3 by a pivotal connection 26 on a mount 27. Thus, each of these guide bushings can tilt as it slides along the respective guide rod 21 or 22**.

To shift the seat 4 and the seat frame 7 from a first position to a second extended position, a spindle drive 30 having a spindle nut 31 and a threaded spindle 32 is provided. The spindle drive operates in a known manner and as illustrated the drive 30 is secured to the frame 7 of the seat by a pivotal connection 33 which is received in support mounts 34. The spindle nut 31 is also pivotally mounted by a pivotal connection 35 to a support mount 36 which is attached to the support frame 3. Thus, when the motor or drive 30 rotates the threaded spindle 32 in one direction, the distance between the nut 31 and the motor increases and results in the seat frame 7 and seat 4 being shifted in the direction of arrow 50. With this shifting, the guide bushings 24 and 25 are displaced or slide along the guide rods 21 and 22. During this movement, each roller 19 moves along the inclined plane of its track 20. The roller is pressed against the track due to the dead weight of the back rest 5. It can be seen in conjunction with the illustration of FIG. 3 that together with the forward motion of the seat frame 7 and the rolling of the roller 19 on track 20, the roller lever 16 will rotate around the second axis 17 with the consequence that the tie rod 13 is moved toward the right in the direction of the arrow 52 (FIG. 3). Due to movement of the tie rod, the back rest is tilted back to rotate in the direction of arrow 55 (FIG. 1).

As mentioned before, the guide rods such as 21 and 22 are advantageously disposed in a pair along each side. However, a single pair of guide rods or guide members could be utilized or a combination of two guide rods in the rear of the seat and a centrally positioned guide rod in the front area could be utilized. The arrangement of two pairs of guide rods, however, is more advantageous because of the better disposition of the drive part 30 and a greater security against tipping of the chair.

Although various minor modifications may be suggested by those versed in the art, it should be understood that we wish to embody within the scope of the patent granted hereon, all such modifications as reasonably and properly come within the scope of our contribution to the art.

We claim:

1. In a chair for a dental patient comprising a chair substructure containing a support frame, a superstructure containing a seat having a seat frame, a back rest, means for pivotally hinging the back rest to the seat, displacement means being disposed between the support frame and the seat frame including a straight line mechanism for shifting the seat frame between a first position with the seat being substantially level and a second position with the seat moved the maximum amount from the first position, control means for controlling the inclination of the back rest as the seat moves between the first position and second position, said control means holding the back rest in an upright position when the seat is in the first position and tilting the back rest as the seat moves toward the second position, and means for tilting the seat as it moves from the first position toward the second position, the improvements comprising the means for pivotally hinging the back rest to the seat including a pivotal bearing having a first pivot axis approximately in the area of the hip joint of a person sitting in the chair, said pivotal bearing including a bearing part rigidly connected to the back rest, said control means comprising a first lever arm mounted for pivotal movement on a second pivot axis on the seat frame, a second lever arm mounted for pivotal movement on said second pivot axis and rigidly connected to move with the first arm, a projection on the bearing part of the back rest extending into the seat adjacent the seat frame, and a tie rod connecting an end of said projection to the first arm, said second arm having a roller riding on a track disposed on the support frame so that the second and first arms pivot around their connection as the seat frame moves from the first position toward the second position to allow the back rest to pivot on the first pivot axis.

2. In a chair according to claim 1, wherein the first and second lever have the same length between the pivotal connection to the seat frame and the pivotal connection to the roller and tie rod respectively so that the two levers form an isosceles triangle.

3. In a chair according to claim 2, wherein the two levers are a one-piece member.

4. In a chair according to claim 1, wherein a pair of pivotal bearings are provided with one disposed on each side of the seat, each of the pivotal bearings having a projection extending into the seat frame, a pair of first lever arms disposed on each side of the seat frame with each lever arm being connected to the projection on its side by a tie rod.

5. In a chair according to claim 4, wherein the first and second levers are a one-piece member with the distance from the connection of each lever to the side of the seat frame to the connection for the roller and tie rod being the same so that the one-piece member has the shape of an isosceles triangle.

6. In a chair according to claim 1, wherein the means for tilting the seat comprises a pair of guide rods being mounted on the seat and inclined to each other with an obtuse angle, a guide bushing received on each of the guide rods, each of said guide bushings being pivotably mounted on the support frame so that as the straight line mechanism shifts the chair between the first position and the second position, said bushings move on the guide rods and said seat frame is tilted.

7. In a chair according to claim 6, wherein the two guide rods are disposed adjacent one side of the seat frame and a second two guide rods extending parallel to the first two is mounted adjacent the opposite side, guide bushings received on said second pair, said guide bushings being pivotally mounted on the support frame.

8. In a chair according to claim 6, wherein each of the two guide rods are inclined at an angle of approximately 10° relative to the horizontal.

9. In a chair according to claim 8, wherein the two guide rods are disposed adjacent one side of the seat frame, a second pair of guide rods extending parallel to the first pair being mounted on the seat frame adjacent the opposite side, said second pair also having guide bushings slidably received thereon, said guide bushings being mounted for pivotal movement on the support frame.

10. In a chair for a dental patient comprising a chair substructure containing a support frame, a superstructure containing a seat having a seat frame, a back rest, means for pivotally hinging the back rest to the seat, displacement means being disposed between the support frame and the seat frame including a straight line mechanism for shifting the seat frame between a first position with the seat being substantially level and a second position with the seat moved the maximum amount from the first position, control means for controlling the inclination of the back rest as the seat moves between the first position and second position, said control means holding the back rest in an upright position when the seat is in the first position and tilting the back rest as the seat moves toward the second position, and means for tilting the seat as it moves from the first position toward the second position, the improvements comprising the means for pivotally hinging the back rest to the seat including a separate pivotal bearing on each side of the seat having a first pivot axis approximately in the area of the hip joint of a person sitting in the chair, each of said pivotal bearings including a part rigidly connected to the back rest, said control means comprising a pair of first lever arms mounted adjacent the sides of the seat frame for pivotal movement around a second pivot axis, a second lever arm mounted for pivotal movement on said second pivot axis and rigidly connected to move with the first arm, a projection on each of the bearing parts of the rear seat extending into the seat adjacent the seat frame, and a tie rod connecting said end of said projection to the first arm, said second arm having a roller riding on a track disposed on the support frame so that the second and first arms pivot around their pivot axis as the seat frame moves from the first position toward the second position to allow the back rest to pivot on the first pivot axis.

11. In a chair according to claim 10, wherein there are a pair of second lever arms and a pair of tracks so that each of the second lever arms has a roller riding on a separate track as the first and second lever arms pivot on the pivot axis.

12. In a chair according to claim 11, wherein the first and second lever arms on each side are formed as a single member with a common bearing for mounting the lever arms on the second pivot axis.

13. In a chair according to claim 12, wherein the distance from the roller to the common bearing and the distance from the common bearing to the connection of the first arm form an isosceles triangle.

14. In a chair according to claim 10, wherein the means for tilting the seat include at least two guide members being mounted on the seat frame to be inclined to the horizontal plane and forming an obtuse angle to each other, a sleeve member received on each of said guide members, said sleeve member being pivotally connected to the support frame so that as the chair is moved by the straight line mechanism between the first and second positions, the seat is tilted in response to movement of the sleeve members on the guide member.

15. In a chair according to claim 14, wherein each of said members is inclined at approximately 10° to the horizontal plane.

16. In a chair according to claim 10, wherein the means for tilting the seat comprises two pairs of guide rods with one pair of guide rods being mounted on the seat frame adjacent one side with the two rods of the pair forming an obtuse angle with each other and being inclined to the horizontal plane, the other pair being mounted to the seat frame adjacent the opposite side and extending parallel to the rods of the first pair, a guide sleeve received on each of said rods, each of said guide sleeves being mounted for pivotal movement on the support frame so that as the guide sleeves move on said rods said seat is tilted.

17. In a chair according to claim 16, wherein each of the guide rods of each pair form an angle of approximately 160° to each other.

* * * * *